United States Patent [19]

Bennett

[11] 4,071,086

[45] Jan. 31, 1978

[54] APPARATUS FOR PULLING TOOLS INTO A WELLBORE

[75] Inventor: John D. Bennett, Denton, Tex.

[73] Assignee: Suntech, Inc., Wayne, Pa.

[21] Appl. No.: 698,658

[22] Filed: June 22, 1976

[51] Int. Cl.[2] ..... E21B 19/08

[52] U.S. Cl. ..... 166/177; 180/7 R; 254/134.6

[58] Field of Search ..... 166/177; 254/134.5, 254/134.6; 180/7 R; 173/117

[56] References Cited

U.S. PATENT DOCUMENTS

| | | | |
|---|---|---|---|
| 2,340,959 | 2/1949 | Harth | 166/177 X |
| 2,917,762 | 12/1959 | Xenis | 254/134.6 X |
| 2,974,932 | 3/1961 | Xenis | 254/134.5 |
| 3,054,464 | 9/1962 | Ondeck | 173/117 |
| 3,137,483 | 6/1964 | Zinkiewicz | 180/7 R |
| 3,957,162 | 5/1976 | Söderquist | 180/7 R |

*Primary Examiner*—Price C. Faw, Jr.

*Assistant Examiner*—William F. Pate, III

*Attorney, Agent, or Firm*—J. Edward Hess; Donald R. Johnson; James H. Phillips

[57] ABSTRACT

A pulling tool apparatus for helping equipment descend down a wellbore, such as logging tools being dropped into a deviated wellbore. A first embodiment employs a mass slidably located inside the pulling tool which is acted on so that it is propelled in an upward direction at a fast rate and then propelled in a downward direction at a slow rate so that the net effect of the moving mass on the logging cable is to pull it in a downward direction because of the reaction forces exerted on the tool itself by the moving mass. An alternative embodiment is provided wherein the mass is driven downward against a stop plate to create the downward force for the pulling tool. An additional feature to improve performance is a set of fins surrounding the outside of the pulling tool which will fold when the tool moves in a downward direction and will open up to offer resistance to motion in an upward direction.

3 Claims, 5 Drawing Figures

APPARATUS FOR PULLING TOOLS INTO A WELLBORE

BACKGROUND OF THE INVENTION

This invention is related to tools for use inside a wellbore and more specifically to an apparatus for pulling a logging cable and logging device down into a deviated borehole.

When drilling for oil from offshore drilling platforms, it is usually the established practice to drill outward from the tower in many different directions, so as to best utilize the platform. The result is a wellbore which does not go straight down but extends downward and outward at an angle from horizontal. These deviated boreholes create different problems than those encountered in conventional onshore drilling operations. One problem encountered when trying to determine the location of these boreholes, occurs when a logging tool is dropped down the borehole. Since the borehole is often drilled at quite an angle, the force of gravity on a logging tool and logging cable is not sufficient to overcome the friction encountered by the tool and cable against the side of the borehole. Often times many man hours of work are lost in trying to force the logging tool to the bottom of the borehole. It is therefore desirable to have some type of a tool which will aid the logging tool in its descent down through the wellbore.

Several kinds of pulling devices have been tried in the past. However, none of these have proven to be effective. These designs include crawling and vibrating devices as well as attempts to use stiff cables or drilling mud to push the equipment down the borehole.

SUMMARY OF THE INVENTION

In accordance with several embodiments, a pulling tool is disclosed which helps to pull the logging tool and logging cable, or other tool, down into a deviated borehole. The preferred embodiment includes a mass slidably mounted within the pulling tool body and having means for propelling the suspended mass in an upward direction at a fast rate and then reversing the direction of the mass to pull it downward at a slow rate of speed, so that the net effect is to pull the logging tool into the wellbore as a result of the reaction forces from moving the mass. Several designs for the propelling means are possible. The preferred design includes the use of a coil wrapped around the path of the mass to operate on the mass like a solenoid system and energized so that the mass is pulled in an upward direction faster than it is pulled in the downward direction. Switching systems can also be provided to selectively energize the coils as well as to vary the strength of each to control the upward and downward movement of the mass.

An alternative embodiment is provided wherein the action of the slidable mass downward against a stop plate is used to move the pulling tool instead of the reaction force from the movement of the mass. Electromagnets or a coil arrangement as provided for the preferred embodiment can be used to propel the mass.

An additional feature is a set of specially designed fins placed around the pulling tool body which are designed to permit the fins to fold toward the body when the pulling tool moves in a downward direction and fold outward from the pulling tool body when the tool is pulled in the upward direction. The fins can be used with any of the propelling devices discussed above as well as with a means for vibrating the pulling tool so that it is able to move in a generally downward direction.

The pulling tool apparatus can be designed for operation with a conventional logging system and with the power usually provided for these systems. Furthermore, the preferred embodiment is designed to have few moving parts and should therefore require little maintenance as compared to those systems available in the prior art.

A better understanding of this invention and its advantages can be seen in the following description of the figures and preferred embodiment.

DESCRIPTION OF THE FIGURES AND PREFERRED EMBODIMENT

Figure 1:
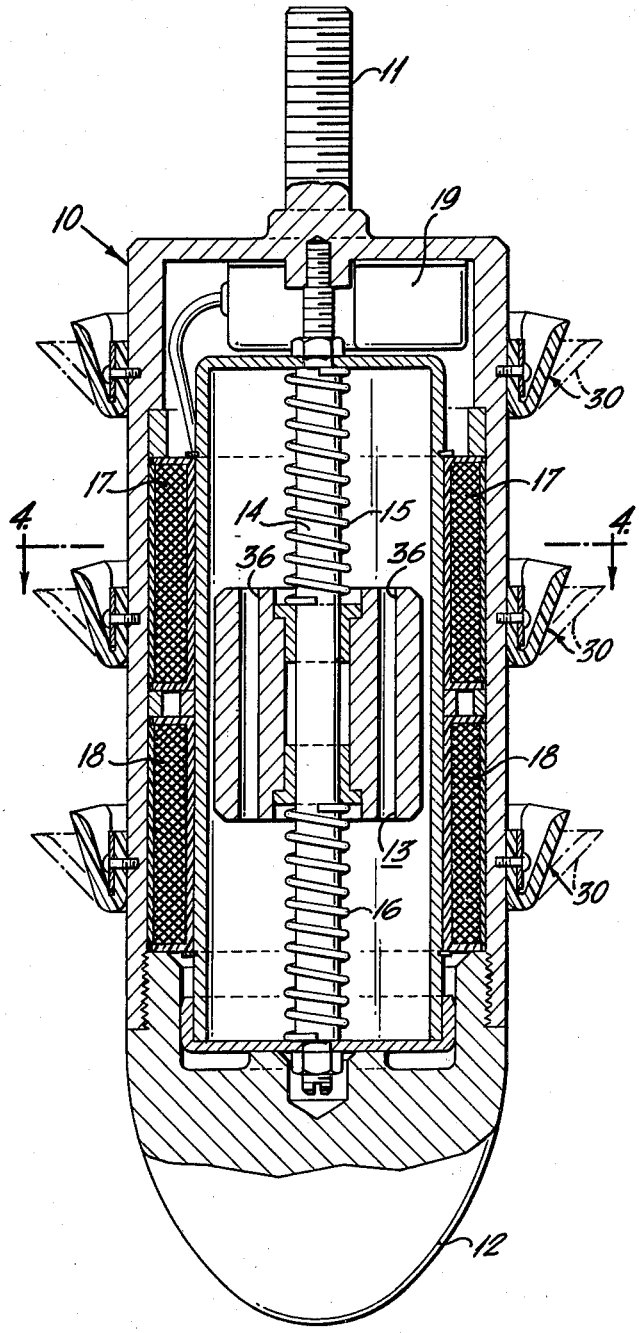
FIG. 1 illustrates in schematic form the preferred embodiment of the pulling tool.

Referring to the preferred embodiment illustrated in FIG. 1, the pulling tool has a body shell 10, preferably cylindrical in shape, with a coupling 11 mounted on its upper end for connection to the end of a logging tool and a streamline lower end 12. A mass 13 is slidably mounted inside shell 10 on central track 14. Mass 13 is preferably constructed from a high density material to make it quite heavy as compared to the weight of shell 10. Connecting springs 15 and 16 act as positioners to zero the position of mass 13 within shell 10.

For the purpose of propelling mass 13, two coils are provided to act on mass 13 in a manner similar to the coils of a solenoid on its core. Upper coil 17 acts to draw mass 13 in an upward direction and lower coil 18 acts to pull mass 13 in a downward direction. To function properly, mass 13 would also have to be constructed out of ferromagnetic material. Through holes 36 in mass 13 help reduce air drag on mass 13.

Coils 17 and 18 are connected in with a control system 19 for proper sequential operation so that mass 13 is moved in an upward direction at a fast velocity, thereby exerting a reaction force on the pulling tool in the downward direction because of the energy required to raise mass 13, and then allowed to return to its lower position at a slow rate, thereby exerting a small reaction force on the pulling tool since little energy is required. This movement of mass 13 results in a net reaction force on body 11 in the downward direction.

One possible method of accomplishing this net result is to energize upper coil 17 to attract mass 13, and then gradually de-energize it to permit mass 13 to slowly return to its lower position. Another method is to energize upper coil 17 to attract mass 13 and lower coil 18 to repel mass 13; and then to pull mass 13 downward, energize lower coil 18 to attract mass 13 and vary the power to each coil so as to let mass 13 down slowly. Also, the number of windings in each coil, which determines the strength of each coil, can be selected to achieve the relative strength differences desired. For instance, the number of windings in lower coil 18 can be much less than the number in upper coil 17, so that when both coils are engergized, the net force on mass 13 is to allow it to gently fall downward. Control system 19 can include relays and potentiometers arranged to accomplish these various sequential operations. Specific designs for system 19 are not provided since they are within the expertise of those skilled in this art.

Figure 2:
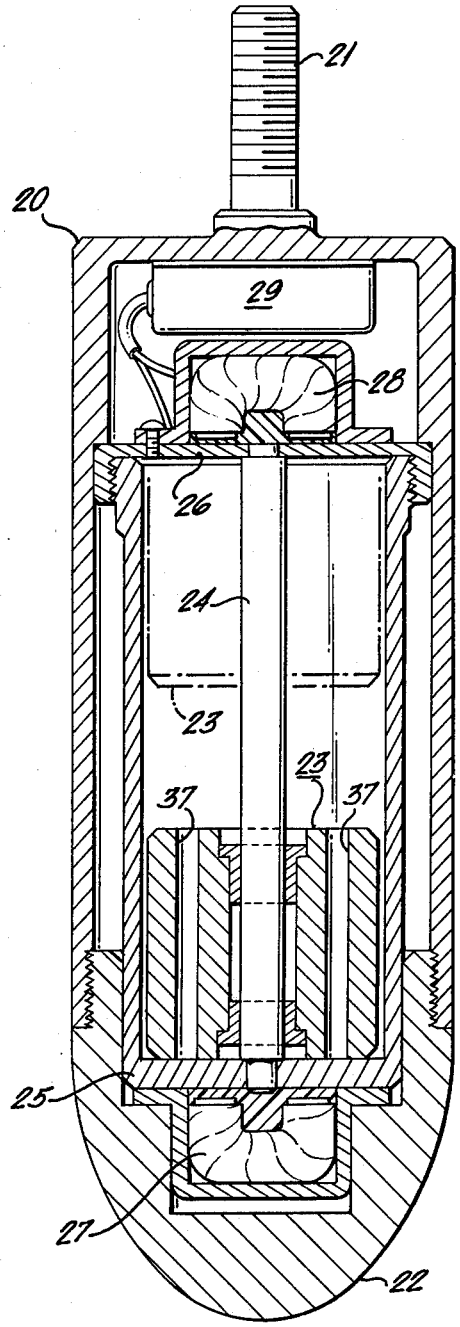
FIG. 2 illustrates in schematic form an alternative design of the first embodiment which uses a solenoid system.

Referring to the alternative embodiment illustrated in FIG. 2, the pulling tool apparatus also has a body shell 20, preferably cylindrical in shape, with a coupling 21 mounted on one end for connection to a logging tool and a streamline nose end 22. Included inside shell 20, is a propelling system having a mass 23 slidably mounted central track 24. Stop plate 25 and limit plate 26 provide lower and upper restriction on the movement of mass 23. Stop plate 25 must be built so that it can withstand repeated contact by mass 23. Through holes 37 help reduce air drag on mass 23 by permitting air to flow through mass 23.

Several propelling systems for movement of mass 23 are possible. One system, which is illustrated in FIG. 2, accomplishes movement of mass 23 by an electromagnetic system which includes electromagnets 27 and 28 mounted in conjunction with stop plate 25 and limit plate 26 and having mass 23 made from a heavy ferromagnetic material. Energizing electromagnet 27 causes mass 23 to be pulled against stop plate 25 and energizing electromagnet 28 causes mass 23 to be attracted toward limit plate 26. Control system 29 can be designed to regulate the energizing of the two electromagnets. In fact, system 29 can also be designed to regulate the amount of energy applied to the electromagnet so as to better control the movement of mass 23. Electronic switching circuits or relay circuits with variable resistances can be designed by those skilled in the art to provide these functions of control system 29.

In the operation of this alternative embodiment, the body of the pulling device would be connected to the lower end or leading end of a logging tool or other equipment by means of coupling 21. In one mode of operation, control system 29 would energize the electromagnets in a sequential fashion in which electromagnet 27 would be deactivated and electromagnetic 28 would be activated to pull mass 23 against stop plate 25, so that a downward motion is exerted on the entire logging tool and logging cable. Then electromagnet 28 is activated and electromagnet 27 is deactivated to gently pull mass 23 in an upward direction against limit plate 26. For this sequential operation, the strength of electromagnet 27 would probably be stronger than electromagnet 28 since eletromagnet 28 need be only strong enough to pull mass 23 slowly upward and the strength of electromagnet 27 should be sufficient to quickly pull mass 23 against stop plate 25 with a force sufficiently greater than the reaction force which occurs when starting the movement of mass 23, to result in a net forward or downward motion on shell 20.

Other variations of this sequential operation are possible. Electromagnet 28 can be sufficiently larger than electromagnet 27 so that both are energized to slowly return mass 23 up against limit plate 26. It might also be desirable to vary the power supplied to the electromagnets to better control the movement of mass 23. For instance, the power supplied to electromagnet 27 can be reduced gradually to permit a faster return of mass 23 to limit plate 26, if so desired, or increased gradually to compensate for the reduced effect on mass 23 due to the increasing distance between mass 23 and electromagnet 27.

Another variation would be to reverse the leads to the electomagnets so that the magnetic force opposes mass 23. One example would be to have electromagnet 28 switched to oppose mass 23 when electromagnet 27 is energized to pull mass 23 against stop plate 25. This arrangement may help reduce the size of electromagnets needed, which is extremely important since the pulling tool size is restricted by the size of the wellbore. Also, reversal of the polarity of electromagnet 27 to push mass 23 upward would reduce the size required for electromagnet 28.

The preferred embodiment illustrated in FIG. 1 could be operated similarly to that discussed for the alternative embodiment by eliminating springs 15 and 16 and energizing the coils appropriately to hammer mass 13 against the solid streamline end 12.

The alternative embodiment, in turn, can be easily adapted to function similarly to the preferred embodiment by energization of electromagnets 27 and 28 in a manner similar to energizing coils 17 and 18.

Figure 3:
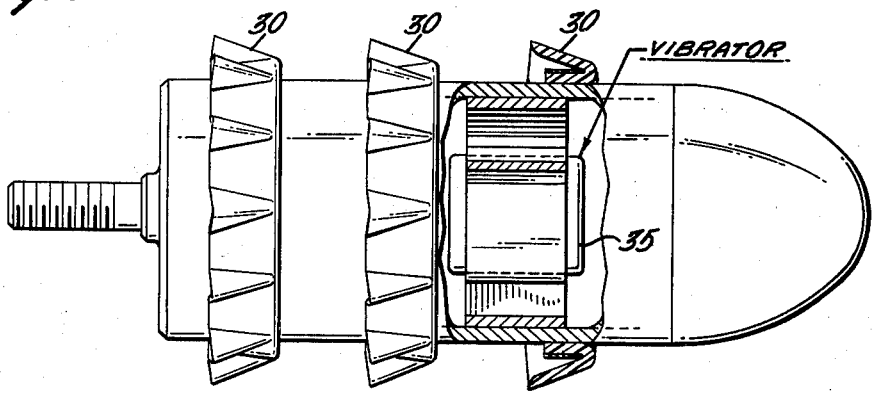
FIG. 3 illustrates in schematic form a pulling tool having fins located around the outside of the body and having a vibrating system therein.
Figure 4:
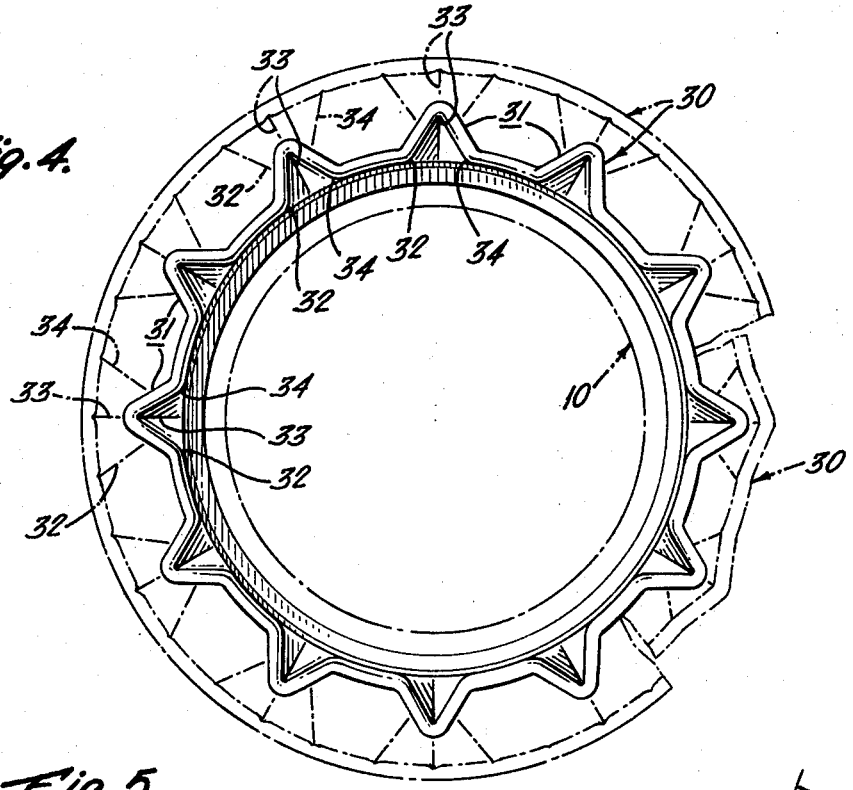
FIG. 4 is a section along the line 4—4 in FIG. 1, illustrating one possible design for the fins, with the fins in the streamlined, partially expanded, and fully expanded positions.
Figure 5:
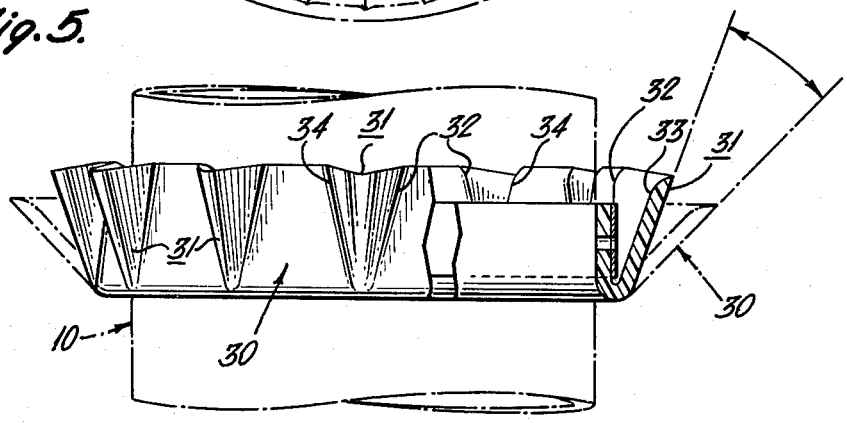
FIG. 5 is a side elevation of the fins in FIG. 4.

An additional element which may be included on the embodiments illustrated in FIG. 1 and 2 to improve performance is a set of fins mounted around the sides of the shell. This fin design, which is shown in more detail in FIG. 4, has a feature which permits the fins to fold up against the side of the shell wall when the pulling tool moves in a downward direction, yet will expand outward to offer resistance to flow if the pulling device moves in an upward direction. Each circular fin 30 has a plurality of folding sections 31, each section having three creases 32, 33, 34. The creases initiate from a single point on the inside edge of fin 30, which is connected to the outside wall of the shell and spread out from each other and terminate on the outer edge of fin 30. Creases 32, 33 and 34 are formed within fin 30 so that when the shell moves forward or downward, the fluid within the wellbore causes fin 30 to be forced back against the side of the shell with creases 32 and 34 pressed against the shell wall and crease 33 extending away from the shell as illustrated in FIG. 4. However, should the shell be urged backwards or upwards, fins 30 would fully expand, as shown in FIG. 3, to offer more resistance to movement in this direction. Proper design of fins 30 to have an angle, similar to that illustrated in FIG. 3, of around 45° from the wall of the shell, will reduce the possibility of the fins being folded in the wrong direction when the shell attempts to move backwards or upward.

Instead of using the pulling tool propelling systems discussed above, the mass displacement system can be replaced by a vibrator system 35 with a plurality of circular fins located around the outside of the shell, as illustrated in FIG. 3. Vibrator 35 helps overcome the frictional forces encountered within the deviated borehole and the fins 30 help to maintain movement of the pulling tool in a forward or downward direction so that the logging tool is pulled into the borehole.

While a particular embodiment of this invention has been shown and described, it is obvious that changes and modifications can be made without departing from the true spirit and scope of the invention. It is the intention of the appended claims to cover all such changes and modifications.

The invention claimed is:

1. An apparatus for pulling tools down into a wellbore, said apparatus comprising:

a. a shell structure forming the body of the pulling tool, said body having a first, downwardly directed end and a second, upwardly directed end;

b. means connected to the shell for providing physical coupling to the tool;

c. a mass slidably mounted in said shell for sliding movement along the longitudinal axis of said shell between first and second positions disposed nearer said first and second ends, respectively;

d. electromagnetic means for sequentially propelling said mass to said second position at a first average rate of speed and returning the mass back to said second position at a second average rate of speed, said first average rate of speed exceeding said second rate of speed so that the net movement of the pulling apparatus is in the lower or downward direction because of reaction to the movement of said mass; and e. at least one fin structure mounted on the outside of said shell structure, said fin structure being designed to offer more resistance to movement of the pulling apparatus in one longitudinal direction than in the opposite direction.

2. The pulling apparatus recited in claim 1, wherein the fin structure is annular in shape, having the inside circumference secured to the outside of the shell structure and slanted back from the front of the pulling apparatus to the outside circumference, and having folding sections which permit the fin structure to move against the side of the shell structure due to the force of fluids against the front side, so that less resistance to the flow of fluids is presented.

3. The pulling apparatus recited in claim 2, wherein said folding section comprises at least two outer and one inner creases located in said fin structure so that said two outer creases can move toward each other and said inner crease moves away from said shell structure to permit said fin structure to move against the side of said shell structure.

* * * * *